United States Patent [19]

Kuwabara et al.

[11] Patent Number: 4,711,098

[45] Date of Patent: Dec. 8, 1987

[54] REFRIGERATOR

[75] Inventors: Takashi Kuwabara, Ohizumi; Yoshiharu Shimura, Ota; Yuko Hayashi, Ohizumi; Toshiyuki Hanamure, Ohizumi; Kaoru Kanemori, Ohizumi; Yoshihiro Yamakawa, Ota, all of Japan

[73] Assignee: Sanyo Electric Co., Ltd., Japan

[21] Appl. No.: 917,398

[22] Filed: Oct. 10, 1986

[30] Foreign Application Priority Data

Oct. 11, 1985 [JP] Japan ..... 60-155838[U]
Nov. 6, 1985 [JP] Japan ..... 60-171075[U]

[51] Int. Cl.[4] ..... F25D 11/02

[52] U.S. Cl. ..... 62/441; 49/368; 312/138 R

[58] Field of Search ..... 62/440, 441; 49/367, 49/368; 312/138 R, 138 A

[56] References Cited

U.S. PATENT DOCUMENTS

| | | | |
|---|---|---|---|
| 1,837,916 | 12/1931 | Michelman | 49/367 |
| 1,918,865 | 7/1933 | Purdy | 49/367 X |
| 2,582,540 | 1/1952 | Gruse | 49/367 |
| 2,692,809 | 10/1954 | Kesling | 49/368 X |
| 3,225,564 | 12/1965 | Horway | 62/440 X |
| 3,590,531 | 7/1971 | Childs | 49/368 |
| 4,428,153 | 1/1984 | Klinger et al. | 49/368 X |

*Primary Examiner*—William E. Tapolcai
*Attorney, Agent, or Firm*—Darby & Darby

[57] ABSTRACT

A refrigerator having French doors, a partition which is rotatably supported by one door thereof and comes in contact with the non-supporting side of said two doors when the doors are close and a housing part which prevents a user from rotating said partition by mistake when said one door is open by housing and holding said partition in said housing part when said door is open.

5 Claims, 17 Drawing Figures

REFRIGERATOR

FIELD OF THE INVENTION AND RELATED ART STATEMENT

This invention relates to a regrigerator having a French door to open and close an opening of an insulated box and being equipped with gaskets for sealing at the rear of said doors.

In the conventional refrigerator having French doors of this kind, in order to keep the inside airtight with gaskets provided at the rear of double doors, there must has been a surface with which the gaskets situated on the non-supporting side of the doors come in contact, and for this reason, closing material which divides the opening of an insulated box was installed (U.S. Pat. No. 3,462,966).

The above-mentioned gaskets are to keep the inside of a refrigerator airtight in contact with the front of said closing material. However, this closing material has such disadvantages that it decreases the volume of the inside and hinders taking the goods in and out.

Therefore, in the conventional refrigerator, as shown in Japanese published unexamined utility model application No. 52082/1980 and U.S. Pat. Nos. 3,726,578, 4,288,135 and 4,226,489 for example, single- or multilayer tongue-like flaps that project outwardly are formed at the gaskets situated on the non-supporting side of double doors and door sealing is made by mutual contact of these flaps, thereby eliminating the aforementioned closing material. However, in view of a remarkable decrease in airtight efficiency owing to deterioration with age, the applicant fitted a rotatable partition to the doors instead of said closing material as shown in Japanese published unexamined utility model application No. 180188/1984 for example.

In the composition shown in the above-mentioned application, the partition composes the contact surface of a gasket only when the first door is closed, and it moves away from the opening edge with the door when the first door is open. Consequently, it does not hinder taking the goods in and out, and can exert sufficient airtight efficiency. However, in the opened state of the first door, the partition projects towards a user and provides a risk that when the goods are taken in and out the partition is touched with the user's hand and is rotated. In addition, the above-mentioned composition has such problems that if the partition is moved when the first door is open and the door is attempted to be closed as it is, the door will not close completely because of the partition and that in the worst case, the partition is broken by the shock given at the time when the door is closed.

SUMMARY OF THE INVENTION

This invention relates to a refrigerator comprising an insulated box having an opening and cooling mechanism, a first and second doors of French door type pivotally mounted on said opening and having gaskets at the rear fringe thereof which come in contact with the edge of said opening to close said opening, guide grooves formed at the edges of said opening on the non-supporting side of said doors, a partition pivotally supported at the rear on the non-supporting side of said first door, extending in the direction of the rotating axis of said first door with length nearly reaching the edges of said opening, having at both ends thereof engaging parts which rotate along said guide grooves with the closing movement of said first door, and forming the contact surface of said gaskets with the surface of the front becoming nearly the same as that of the edges of said opening when the partition is rotated, and a housing part provided at the rear of said first door and housing and holding said partition with said engaging parts protruded when said first door is open.

Namely, according to this invention, when the first door is closed, since the engaging parts provided at the ends of the partition engage with the guide grooves provided at the edges of the opening of the insulated box, the partition provided at the rear of the first door is securely rotated and forms the contact surface of the gasket which becomes nearly the same as the surface of the edges of the opening and consequently the first and second doors close the opening of the insulated box, keeping it airtight sufficiently, and furthermore, when the first door is open, the partition except the engaging parts is housed and held in the housing part provided at the rear of the first door.

Therefore, there is no need to install in the insulated box a dividing material or the like to make the gasket on the non-supporting side of the door contact. Since the whole opening of the insulated box can be used to take the goods in and out, it is convenient to use. At the same time, as it is not necessary to make the gaskets on the non-supporting side contact each other, no deterioration with age takes place and inconvenience such as improper insulation can be avoided.

Furthermore, since the partition is held in the housing part when the door is open, trouble that the partition is rotated by mistake can be avoided and at the same time, the effect that the movements of the partition involved with the opening and closing of the door become sure is obtained.

Especially, by forming the housing part of the partition on the side of storage pockets provided at the rear of the door, the housing part and the partition can be situated, effectively using the space near the pockets. In this way, the space inside the storage chamber is not narrowed extremely and the composition that the housing part and the partition do not hinder taking the goods in and out can be obtained.

BRIEF DESCRIPTION OF THE DRAWINGS

Each drawing shows the embodiments of this invention.

FIG. 7 is a perspective view of a door;

FIG. 8 is a sectional view of a refrigerator corresponding to FIG. 5; and FIG. 9 is a top view of a partition and a housing member.

FIG. 10 is a perspective view of a refrigerator;

FIG. 11 is a longitudinal sectional view of the refrigerator;

FIG. 12 is a fragmentary elevational view of a refrigerating chamber except doors;

FIG. 13 is a perspective view of the rear of a door of the refrigerating chamber; and FIG. 14 is an enlarged horizontal sectional view of a partition.

FIG. 15 through 17 are perspective views showing the fitting condition of a projecting part for fitting and a guide groove at the time when the door is started to be closed, a little before the door is closed and the door is completely closed.

DETAILED DESCRIPTION OF THE PREFERRED EMBODIMENTS

Figure 1:
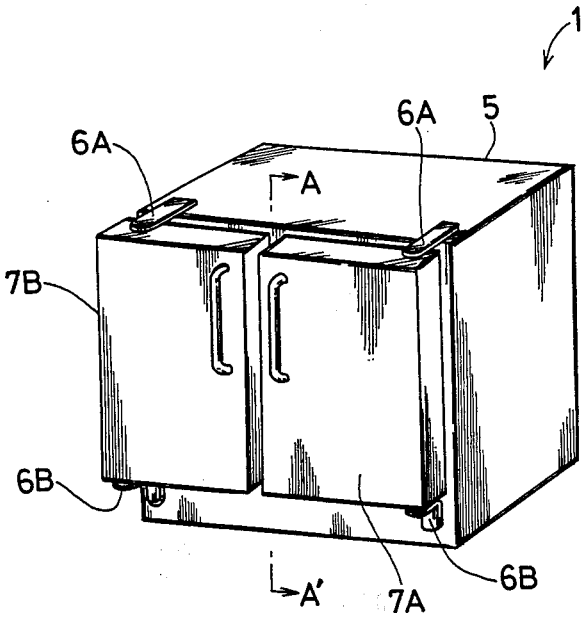
FIG. 1 is a perspective view of a refrigerator.

Referring now to FIGS. 1 through 6 of the accompanying drawings, an embodiment of the present invention will be described. A refrigerator 1 of this embodiment is equipped with an insulated box 5 which consists of a steel plate outer box 2, a plastic inner box 3 and foamed insulating material 4 filled between these boxes 2 and 3 and is open forwardly and two French doors, a first door 7A and a second door 7B, which are pivotally mounted on an upper and lower hinges 6A and 6B at the right and left edges of an opening 5A of said insulated box 5 and fitted to freely open and close said opening 5A.

Figure 2:
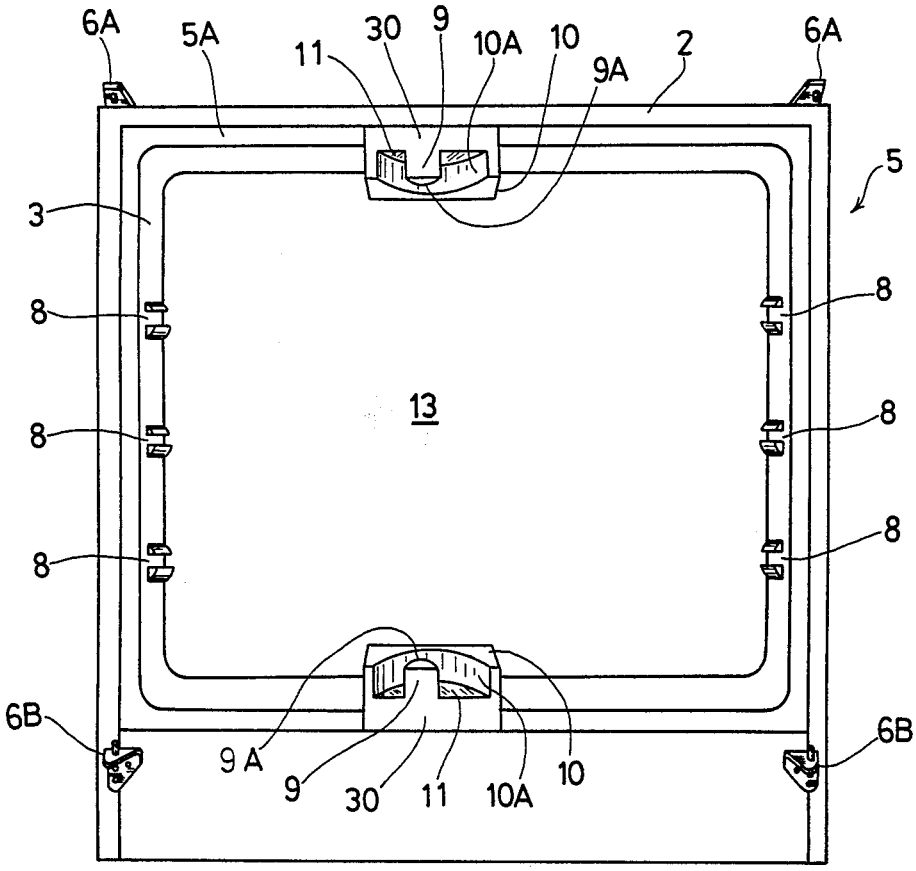
FIG. 2 is an elevational view of an insulated box.
Figure 4:
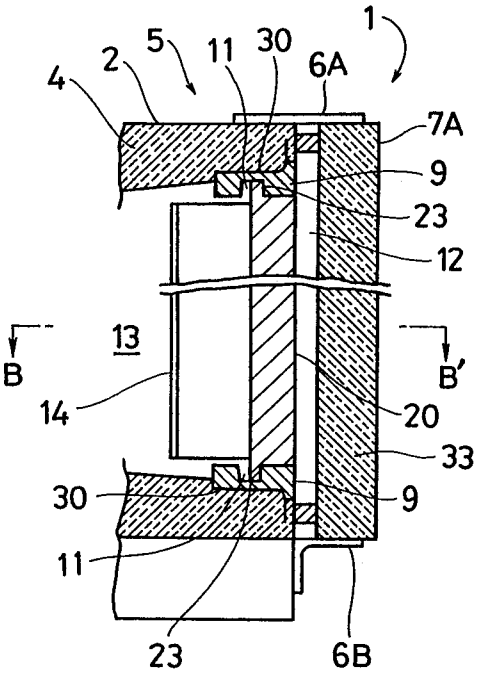
FIG. 4 is a sectional view taken along the line A—A' of FIG. 1.

FIG. 2 shows an elevational view of the insulated box 5. Plural rack rails 8 which extend back and forth at approximately the same horizontal positions are formed along the inside of the walls on both sides of the inner box 3 as an integral part thereof. Guide members 30 are provided face to face with each other at the upper and lower edges of the opening 5A of the insulated box 5 which are situated on the non-supporting side of the first and second doors 7A and 7B. Each guide member 30 has a projecting part 9 in the front and a jetty 10 at the rear. The front of the projecting part 9 is flat and has a surface approximately the same as that of the opening 5A and the rear of the projecting part 9 has a semicircular curved surface 9A for example. The jetty 10 is situated behind the projecting part 9 at a distance. The front of the jetty 10 has such a curved surface 10A that the radius of curvature on the supporting side of the second door 7B becomes larger than that on the non-supporting side. A guide groove 11 is formed between the curved surfaces 9A and 10A.

The guide member 30 may be formed as an integral part of the inner box 3, or can be made by a different member.

Figure 3:
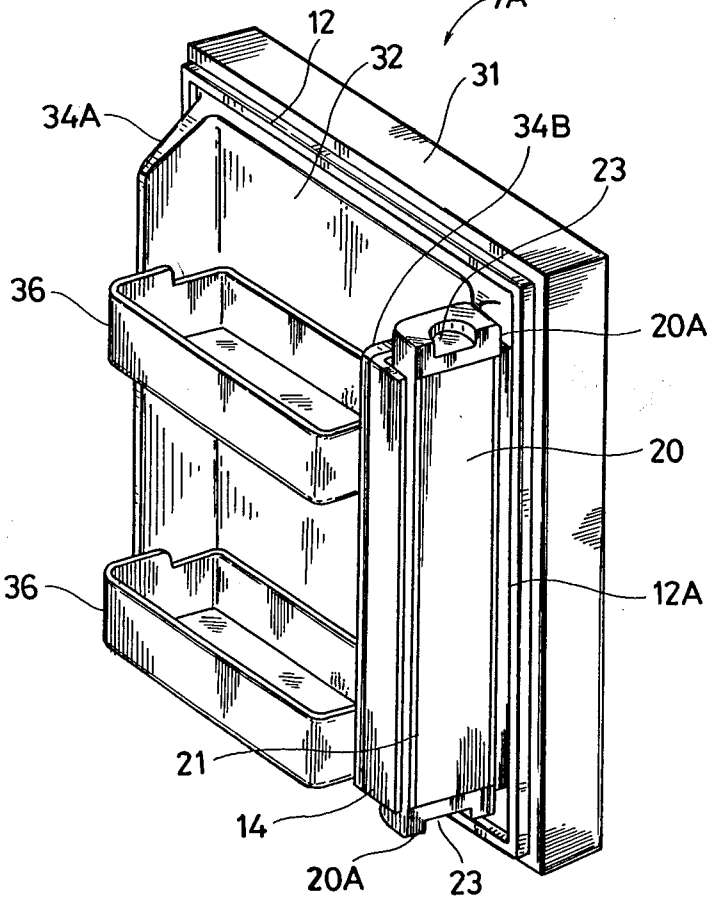
FIG. 3 is a perspective view of a door.

FIG. 3 shows a perspective view of the rear of the first door 7A. Foamed insulating material 33 is filled between an outer plate 31 and an inner plate 32 of the first door 7A (the same as the second door 7B up to this point) and a pair of projecting walls 34A and 34B is formed on both sides of the inner plate 32. A gasket 12 in which a magnet is inserted is fitted to the fringe of the inner plate 32.

Figure 5:
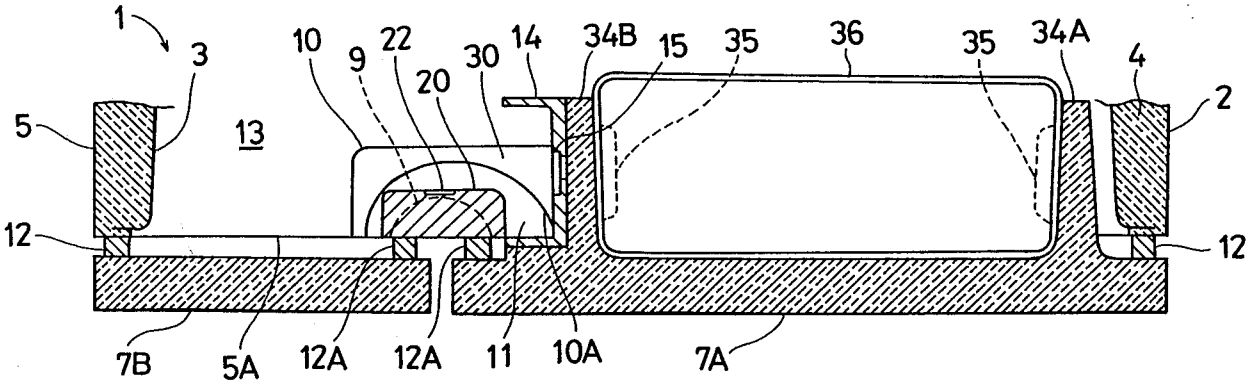
FIG. 5 is a sectional view taken along the line B—B' of FIG. 4.

FIG. 5 is a horizontal sectional view of an opening of the refrigerator 1. The gasket 12 is fitted to the second door 7B as well and adheres by magnetic power to the front edge of the outer box 2 of the opening 5A of the insulated box 5 to seal the refrigerator inside 13 when the first and second doors 7A and 7B are closed. Plural pairs of ribs 35 are projectingly formed on the facing inner surfaces of the projecting walls 34A and 34B and plural storage pockets 36 are supported by these ribs 35.

Figure 6:
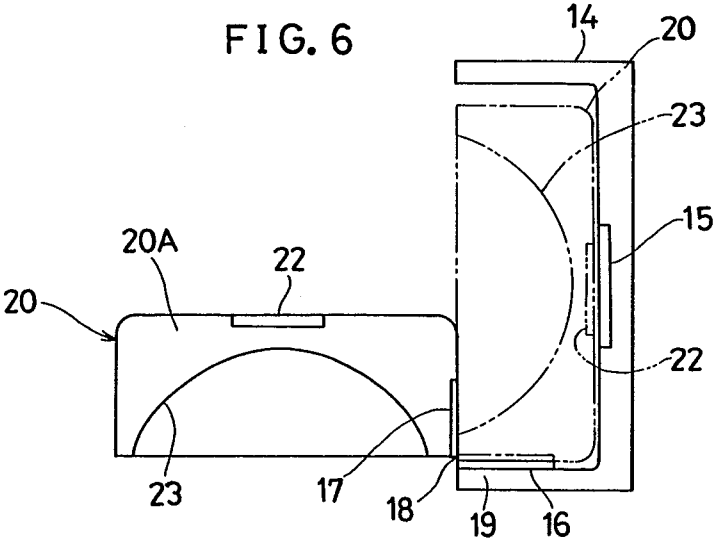
FIG. 6 is a top view of a partition and a housing member.

Mounted on the outside of the projecting wall 34B which is situated on the inside of a gasket 12A located on the non-supporting side of the rear of the first door 7A is a housing part 14 which is of an approximately channel shape in section and open in the direction of the gasket 12 and upward and downward. The housing part 14 has a dimension a little shorter than the distance between the upper and lower guide members 30 and 30 and extends upward and downward, and as illustrated in FIG. 6, a permanent magnet 15 is buried in the inside surface of the side wall on the side of the projecting wall 34B. Fitted to the inside surface at the open end of the housing part 14 on the side of the first door 7A is a plate 16 of a hinge member 19 which is composed of plates 16 and 17 and a thin wall part 18 between these plates and made of polypropylene resin, and fitted to the another plate 17 is a partition 20 having an approximately rectangular shape in section. The partition 20 has a length roughly extending to the upper and lower edges of the opening 5A and extends upward and downward with a dimension a little shorter than the distance between the upper and lower guide grooves 11 and 11 of the guide members 30 and 30. The front of the partition 20 is flat and a steel plate 21 is provided, and the rear corners are curved as shown in FIG. 3. The partition 20 is pivotally movable on the hinge members 19 to the housing part 14, and as shown in FIG. 6, it is freely housed in and removed from the housing part 14. However, the upper and lower ends of the partition 20 protrude from the housing part 14 because of their dimensions, which forms engaging parts 20A. A magnetic plate 22 (for example, steel plate) is buried in the rear of the partition 20. With this arrangement, when the partition 20 is housed in the housing part 14, the magnetic plate 22 is attracted by the permanent magnet 15 so that the partition 20 is not easily removed from the housing part 14. A semicircular concave 23 is formed at each end of the engaging parts 20A.

Next, the movement will be described. When the first door 7A is open (the second door 7B may be either open or close at this time), the partition 20 is housed in the housing part 14 as illustrated in FIG. 3. Strictly speaking, the partition 20 except the engaging parts 20A is housed at this time. In this condition, even if a user's hand, for example, touches the housing part 14 or the partition 20 by mistake, since the partition 20 is held by the housing part 14, there is no risk of rotation. Furthermore, since the partition 20 and the housing part 14 are situated utilizing the space on the side of the pockets 36, the space in the refrigerator inside 13 is not narrowed extremely and the partition 20 and the housing part 14 do not so get in the way when the goods are taken in and out.

When the first door 7A is started to be closed, soon the engaging parts 20A of the partition 20 enter the guide grooves 11 from the inlet of the guide grooves 11 on the side of the first door 7A and then the corners come in contact with the curved surface 10A of the jetties 10 and are rotated, being guided by the curved surface 10A. With this, the partition 20 is rotated counterclockwise in FIG. 6. As a result, the magnetic plate 22 is removed from the permanent magnet 15 and soon the concaves 23 accord with the rear of the projecting parts 9 at the same time with the closure of the first door 7A. At this time, the surface of the steel plate 21 on the front of the partition 20 becomes almost the same as that of the opening 5A, comprising the magnetic adhering surface of the gaskets 12A and 12A of the first and second doors 7A and 7B. Consequently the opening 5A is closed tightly. FIG. 5 shows this condition.

When the first door 7A is opened, the partition 20 is rotated clockwise in FIG. 5 along the curved surface 9A of the projecting part 9 and soon housed in the housing part 14. After that, it is held by the attraction of the magnetic plate 22 and the permanent magnet 15. Here, instead of magnetic force to hold the partition 20 like this embodiment, the partition 20 may be held by the engagement of a concave or a projection formed at the opening of the housing member 14 and a projection or a concave formed on the non-supporting side of the partition 20.

Figure 7:
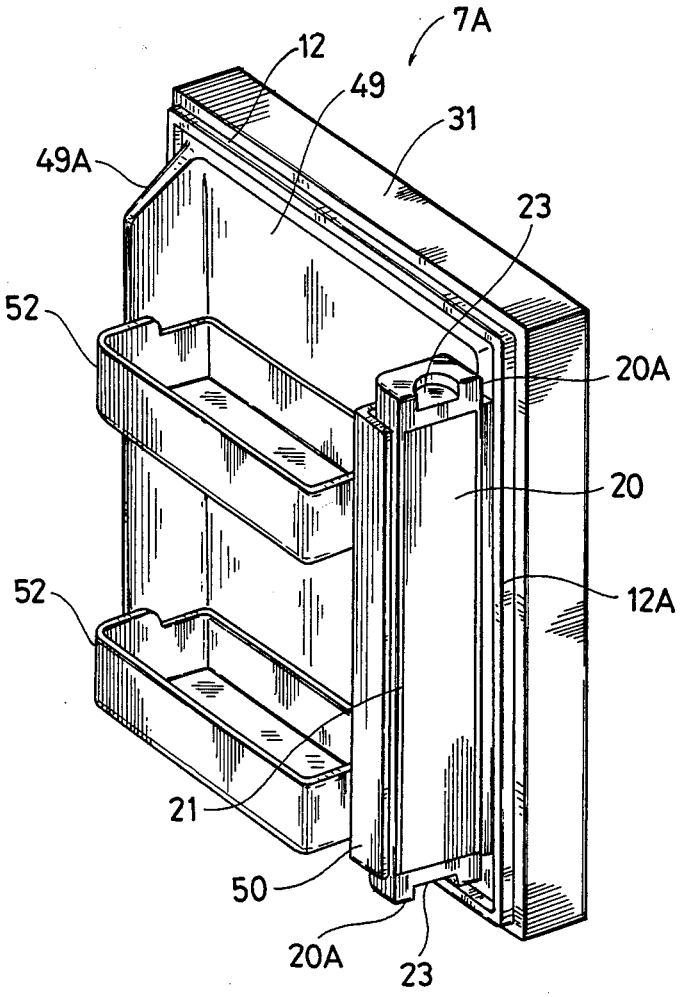
FIG. 7 through 9 show another embodiment of this invention.
Figure 8:
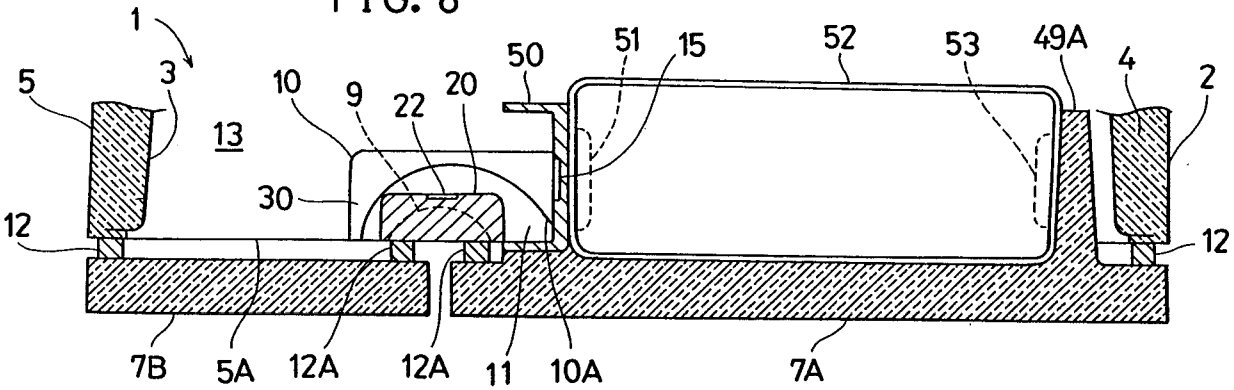
Figure 9:
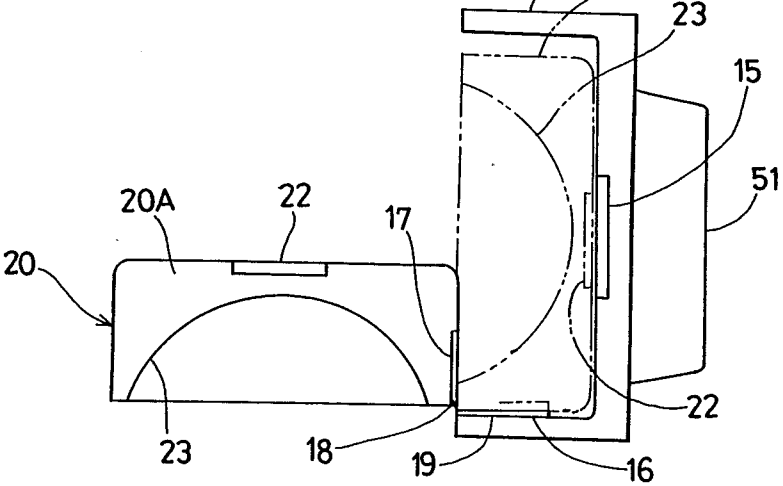

FIGS. 7 through 9 show another embodiment of the first door 7A. In these figures the same numbers as those in FIGS. 1 through 6 represent the same parts. In this case, a projecting wall 49A similar to the projecting wall 34A is formed on an inner plate 49 on only the supporting side of the first door 7A and ribs 53 are provided on the projecting wall 49A similarly. There is no wall which corresponds to the projecting wall 34B. Instead, ribs 51 which face the ribs 53 are formed on the surface opposing the projecting wall 49A of a housing part 50. Except said ribs 51, the housing part 14 of the aforementioned embodiment and the housing part 50 of this embodiment are the same. Pockets 52 having a little widened width are supported by these ribs 51 and 53.

This composition facilitates forming because only the projecting wall 49A is formed on the inner plate 49 of the first door 7A.

FIGS. 10 through 17 show one more different embodiment of this invention. A refrigerator 60 is composed of a lower insulated box 61 which opens forwardly and an upper insulated box 62 which is installed over the lower insulated box 61 and opens forwardly. The lower insulated box 61 has such composition that insulating material 65 such as polyurethane foam is foamed and filled at a site between a steel plate outer box 63 and an inner box 64 remotely assembled into said outer box 63. The inner box 64 is composed of a synthetic resin plate made by vacuum forming and a partition wall 64A which divides the inside up and down is also formed as a unit. The insulating material 65 is filled similarly in said partition wall 64A as well. A partition member 66 having insulating property is provided remotely to the upper part of said partition wall 64A. With this partition member 66, the refrigerator is divided into three parts; a refrigerating chamber 67 at the upper part, a partitioning chamber 68 at the lower part but over the partitioning wall 64A and a freezing chamber 69, a space under the partitioning wall 64A.

A partition plate 70 having insulating material on its rear is vertically installed at the inner part of the freezing chamber 69, remoted from the rear of the inner box 64, and a freezer for the freezing chamber 72 is vertically installed in a cold air passage 71 formed at the rear of said partition plate 70. Cold air cooled by the freezer for the freezing chamber 72 is sucked by a blower for the freezing chamber 73 installed over said freezer for the freezing chamber 72, discharged into the freezing chamber 69 through a discharge port 74 formed in the partition plate 70 in the front and returned to the cold air passage 71 through a suction port 75 formed in the lower part of said partition plate 70. With this circulation of cold air, the inside of the freezing chamber 69 is cooled to a freezing temperature of −20° C. for example. Numeral 76 is a drawer type insulating door which closes the front opening of the freezing chamber 69 and a basket 77 can be freely taken in and out of the freezing chamber 69, interlocking with the opening and closing of said insulating door 76.

A freezer cover plate 78 having insulating material on the top is installed at the upper part of the refrigerating chamber 67, remote from the top surface of said refrigerating chamber 67, and a freezer for the refrigerating chamber 80 is installed in a cold air passage 79 formed above the freezer cover plate 78. Installed at the rear of the freezer for the refrigerating chamber 80 is an air blower for the refrigerating chamber (not shown) which is covered by an insulating cover 81 having in its inside an air blower chamber 81A connected to the cold air passage 79. Furthermore, formed at the insulating cover 81 is a duct 82 whose lower end is open to the refrigerating chamber 67 and whose upper end is connected to the cold air passage 79 through the air blower chamber 81A. Part of cold air cooled by the freezer for the refrigerating chamber 80 is sucked by said air blower for the refrigerating chamber, discharged into the refrigerating chamber 67 through the duct 82 and returned to the cold air passage 79 through a suction port 83 formed at the forward end of the freezer cover plate 78. Numerals 84 and 85 are two French doors, a first and a second door, which are pivotally mounted on the right and left opening edges of the refrigerating chamber 67 and plural pockets are provided on the inside surface. Mounted pivotally with the axis in the vertical direction on the inside of the end on the non-supporting side of the first door 84 is a partition 89 which is rotated by guide members 86 and 86 installed face to face at the upper and lower parts of the opening edge of the refrigerating chamber 67 when the first door 84 is closed and which forms the contact surfaces of gaskets 87 and 88 (in which magnets are inserted) on the interior circumference of the first and second doors 84 and 85. Numeral 90 is a storage shelf.

Figure 12:
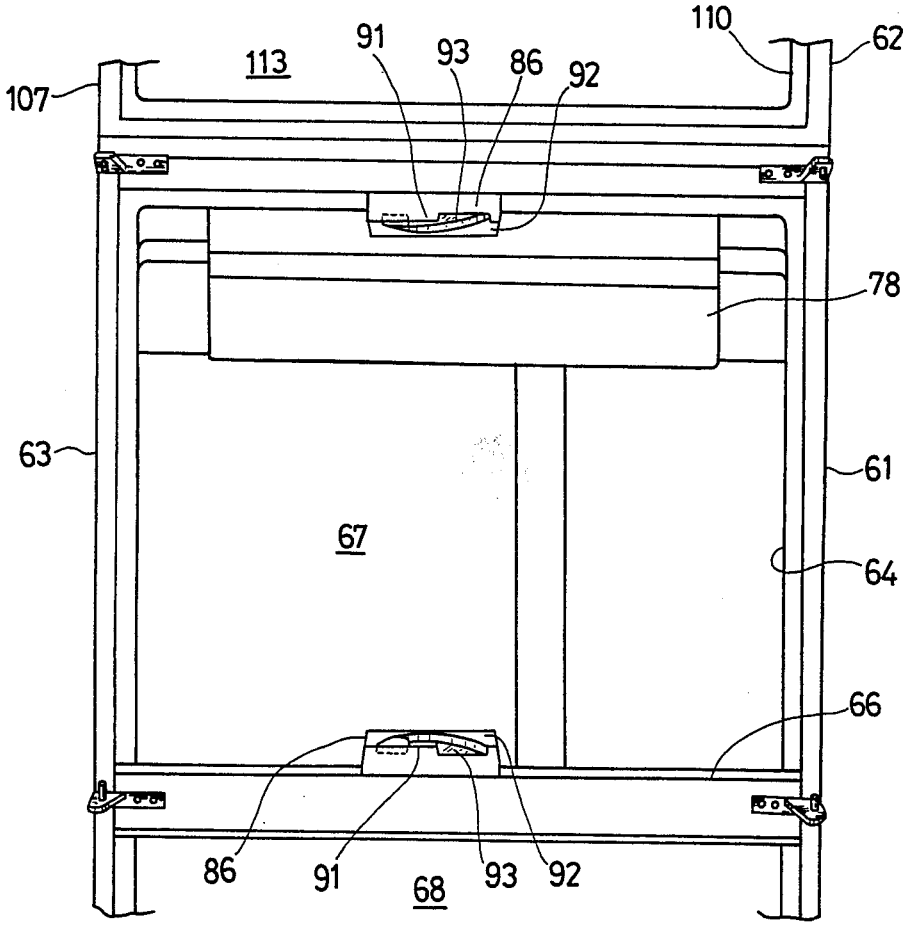
Figure 13:
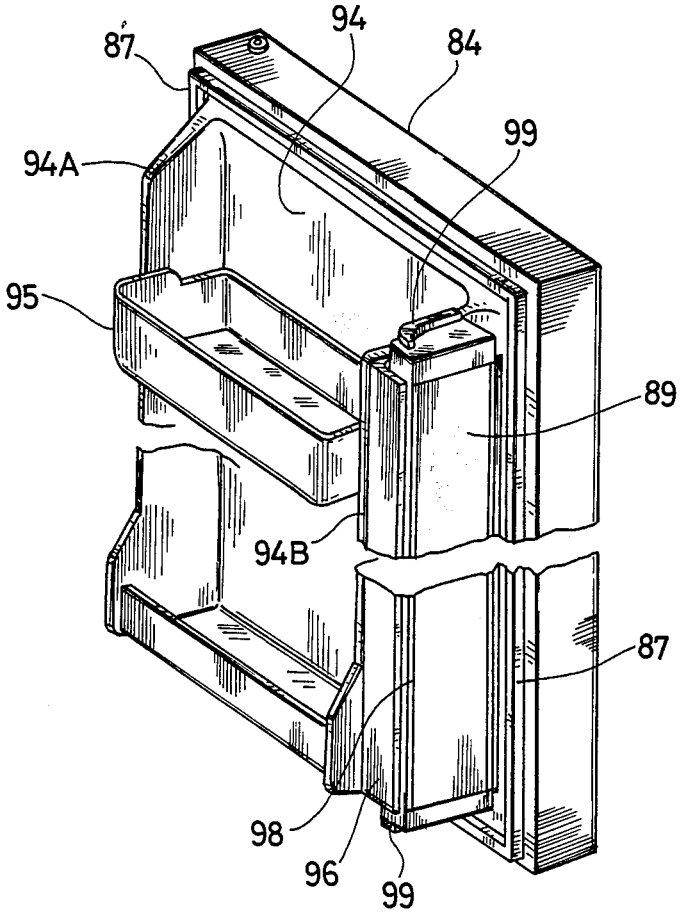
Figure 14:
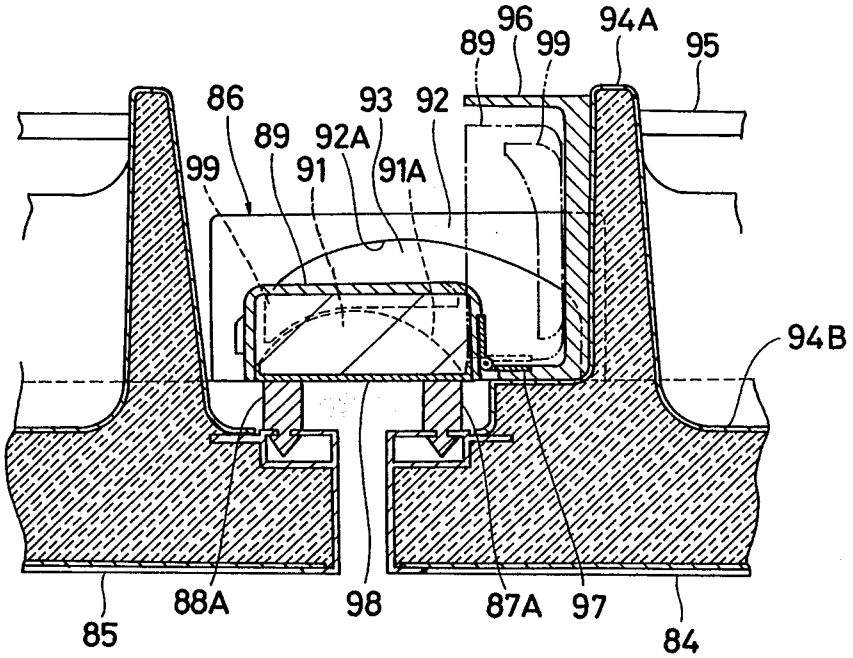

FIG. 12 is a fragmentary elevational view of the refrigerating chamber 67 except the first and second doors 84 and 85 and the storage shelf 90, FIG. 13 is a perspective view of the rear of the first door 84 and FIG. 14 is a sectional view of the partition 89 at the time when the first and second doors 84 and 85 are closed. The guide members 86 and 86 are situated on the non-supporting side of the first and second doors 84 and 85 and provided to the approximately center part of the upper and lower opening edges of the refrigerating chamber 67, facing each other. Each guide member 86 has a projecting part 91 in the front and a jetty 92 at the rear. The front surface of the projecting part 91 is flat and has almost the same surface as the opening edge and the rear has a nearly semicircular curved surface 91A. The jetty 92 is connected to the projecting part 91 on the left side in FIG. 14 and situated behind the projecting part 91. The front of the jetty has such a curved surface 92A that the radius of curvature on the supporting side of the first door 84 becomes larger than that on the non-supporting side. A guide groove 93 is formed between the curved surfaces 91A and 92A. A pair of projecting walls 94A and 94B is formed on an inner plate 94 of the first door 84 and a pocket 95 is supported by these projecting walls 94A and 94B. (This is the same also in the case of the second door 85.)

The gaskets 87 and 88 fitted to the rear fringe of the first and second doors 84 and 85 adhere by magnetic force to the front edge of the outer box 63 of the opening edge of the lower insulated box 61 to seal the refrigerating chamber 67 when the first and second doors 84 and 85 are closed. Mounted on the outside side of the projecting wall 94B which is situated on the inside of a gasket 87A located on the non-supporting side of the rear of the first door 84 is a housing part 96 of about channel shape in section which is open in the direction of the gasket 87A and upward and downward. This forms the housing part of the partition. The housing part 96 has a dimension a little shorter than the distance between the upper and lower guide members 86 and 86 and extends upward and downward, and the partition 86 having a nearly rectangular shape in section is pivotally mounted on hinges 97 at the open end on the side of the first door 84. The partition 89 has a length roughly extending to the upper and lower edges of the opening and extends upward and downward with a dimension a little shorter than the distance between the upper and lower guide grooves 93 of the guide members 86 and 86. The front of the partition 89 is flat and a front plate 98 is provided. The corner is curved. The upper and lower ends of the partition 89 protrude from the housing member 96 and this part has a projecting part for engaging 99 whose front is curved.

Figure 10:
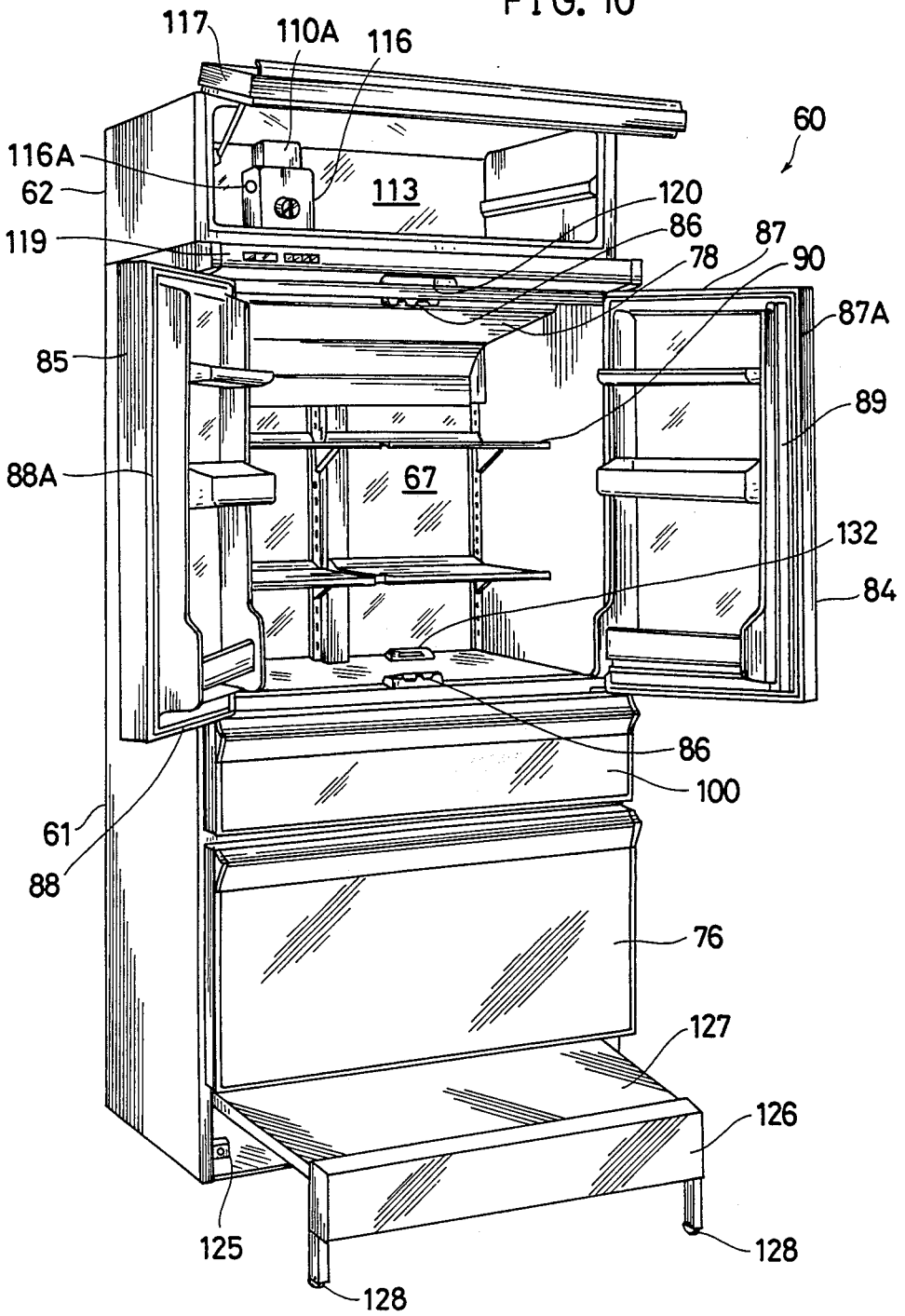
FIG. 10 through 17 show one more different embodiment of this invention.
Figure 11:
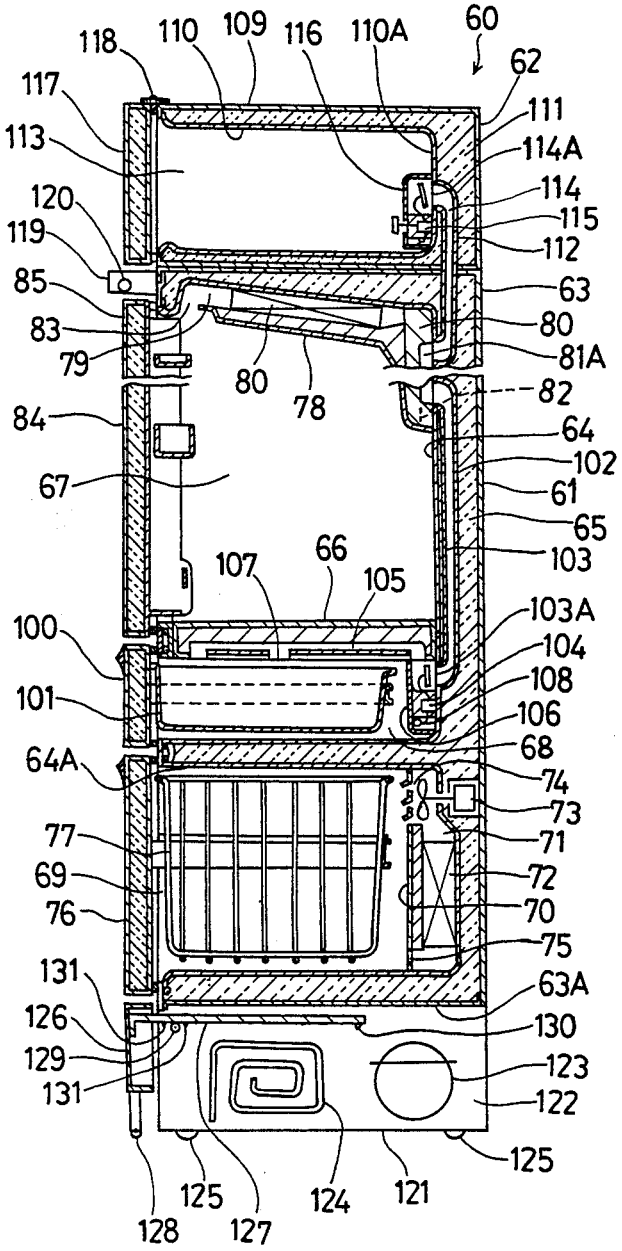
Figure 15:
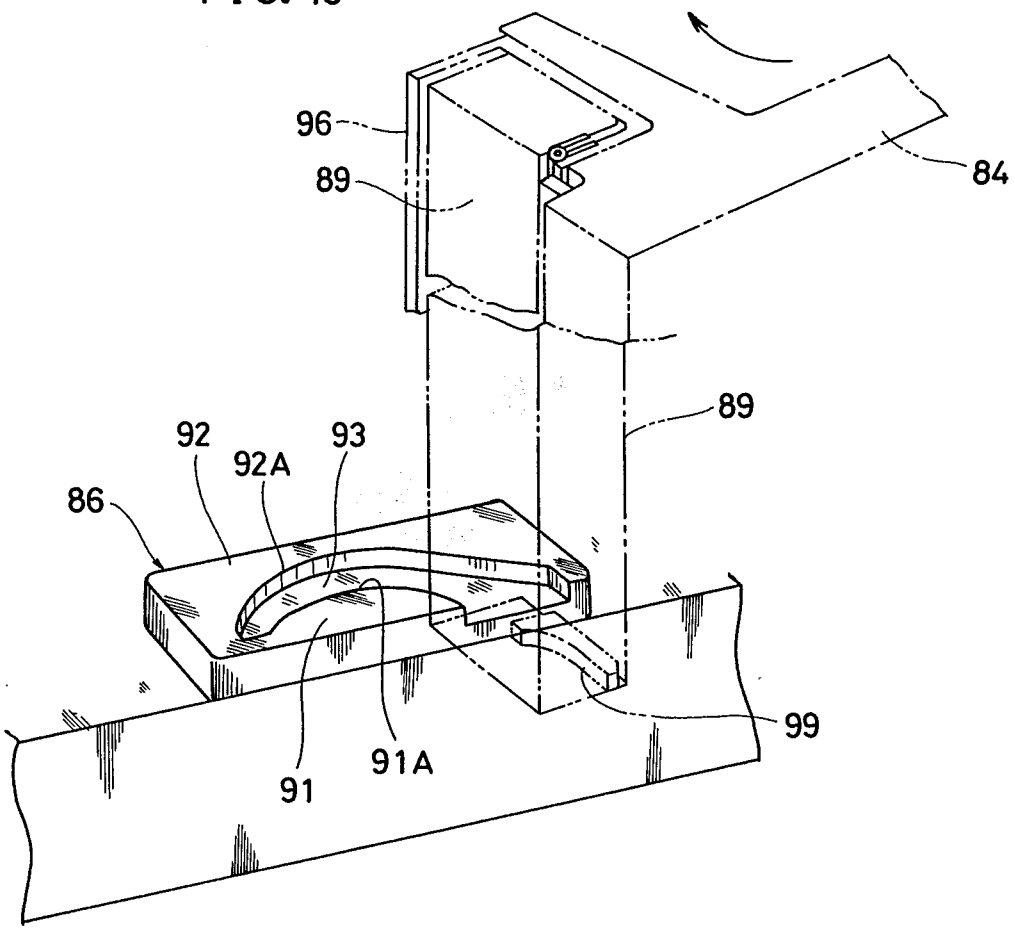
Figure 16:
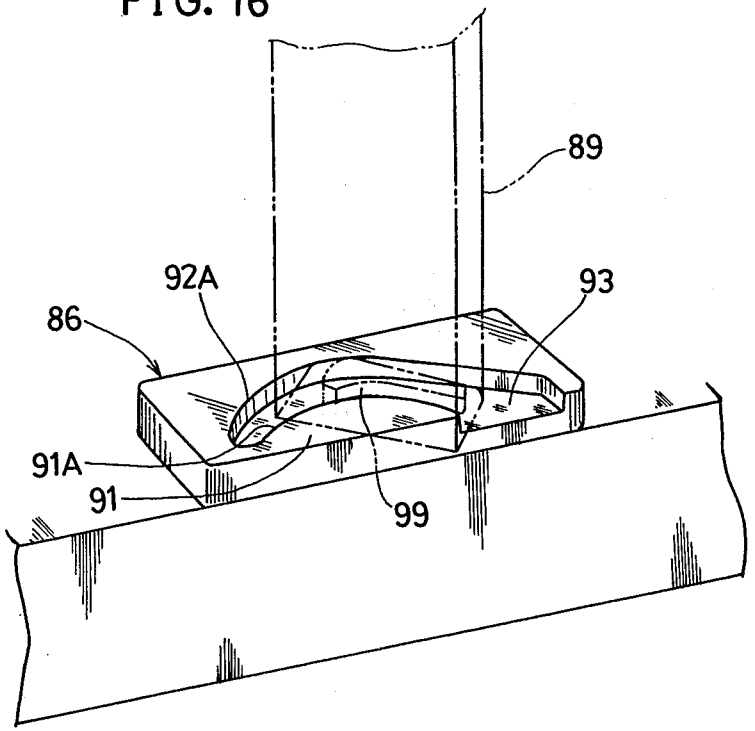
Figure 17:
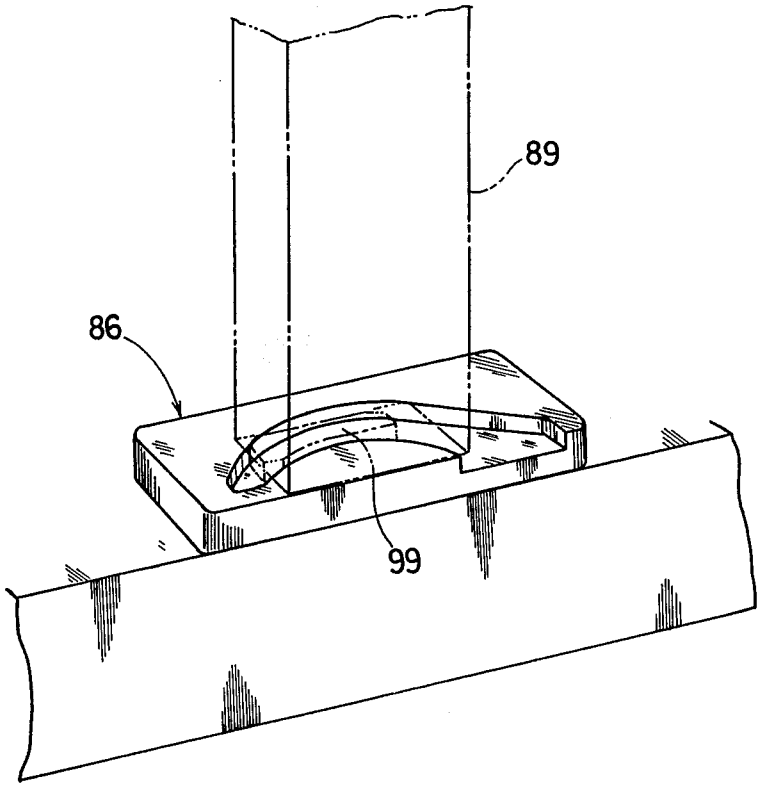

When the first door 84 is open, the partition 89 is housed in the housing member 96 as shown with the one-dot chain line in FIGS. 10, 13 or 14. When the second door 85 is opened in this condition, no partition 89 exists in the opening of the refrigerating chamber 67. Thus the whole opening can be used to take food in and out and it is very practical. Next, when the first door 84 is started to be closed in the direction of the arrow as shown in FIG. 15, the projecting part for engaging 99 of the partition 89 enters the guide groove 93 from the inlet on the side of the first door 84. Then said projecting part for engaging 99 comes in contact with the curved surface 92A of the jetty 92 and is guided as shown in FIG. 16. The partition 89 is rotated counterclockwise in FIG. 14, and as shown in FIG. 17, soon the projecting part for engaging 99 accords with the rear of the projecting part 91 at the same time with the closure of the first door 84. At this time, the surface of the front plate 98 of the partition 89 becomes nearly the same as that of the opening. This composes the magnetic adhering surface of the gaskets 87A and 88A of the first and second doors 84 and 85 and the opening is closed tightly. When the first door 84 is opened, the projecting part for engaging 99 of the partition 89 is rotated clockwise in FIG. 14 along the curved surface 91A of the projecting part 91 and housed in the housing part 96. This movement is made independent of the second door 85. Therefore, the first and second doors 84 and 85 can be opened and closed independently.

When the first door 84 is open, the partition 89 is attracted and held by the permanent magnet in the housing member 96 in the same way as the above-mentioned embodiment.

Numeral 100 is a drawer type insulating door which closes the front opening of the partitioning chamber 68. Said insulating door 100 is fitted to the lower insulated box 61 and can be drawn out. A container 101 can be freely housed in or taken out of the partitioning chamber 68 through said insulating door 100. Formed at the rear of the refrigerating chamber 67 of the inner box 64 is the projecting wall 64B which protrudes on the side of the refrigerating chamber 67 and extends upward and downward. Buried in the insulating material 65 in said projecting wall 64B is a duct member 102 which extends upward and downward. The duct member 102 forms a duct 103 in its inside. The upper end of the duct 103 is connected to the cold air passage 79 through the air blower chamber 81A covered by the insulating cover 81 and the lower end of the duct 103 is open to a discharge port 103A at the rear of the partitioning chamber 68. Said discharge port 103A is opened and closed by a damper thermostat 104. Moreover, the upper part of said damper thermostat 104 is covered by a cover 106 which is connected to a cold air discharge passage 105 formed in the partition member 66. Said cold air discharge passage 105 has plural discharge ports 107 which are open at the bottoms of the front and of the center of the partition member 66. Formed at the rear of said partition member 66 and the side of the cover 106 is a cold air return passage (not shown) which connects the partitioning chamber 68 and the refrigerating chamber 67. An air blower for the refrigerating chamber is to suck cold air and blow it out on the side. Part of cold air discharged from said blower passes the duct 103, enters the cold air discharge passage 105 from the discharge port 103A through the damper thermostat 104 and returns to the front and the center of the container 101 through the discharge ports 107, and after that, returns to the rear of the refrigerating chamber 67 through a cold air return passage 132 and returns to the cold air passage 79 through the suction port 83 together with circulating cold air in the refrigerating chamber 67. Said air blower for the refrigerating chamber repeats running and stop according to the temperature inside the refrigerating chamber 67 and keeps it at +3° C. for example, while the damper thermostat 104 is so designed that it heats the heat sensible part with a heater and that the inside of the partitioning chamber 68 is kept at a super chilling temperature of 0° C. to −3° C. or a temperature of about +10° C. which suits to store vegetables for example by controlling heat generated from said heater 108 according to the temperature inside the partitioning chamber 68.

Here, the super chilling temperature designates the temperature just before food is frozen though the temperature is below zero as food has such nature that the setting point is below the freezing point. By keeping food at this temperature zone, the propagation of bacteria can be restrained without freezing food and food can be stored for a comparatively long period. Moreover, deterioration in flavor owing to freezing can be avoided.

The upper insulated box 62 consists of a steel plate outer box 109 and a plastic inner box 110 which are open forward and foamed insulating material 111 is filled between them. Buried in said insulating material 111 in a projecting wall 110A formed on the rear of said inner box 110 is a duct member 112 which extends to the upper and lower insulated boxes 62 and 61, passing through the outer boxes 109 and 63. Said duct member 112 forms in its inside a duct 114 whose upper end is open to an upper chamber 113 formed inside the inner box 110 with a discharge port 114A and whose lower end is connected to the cold air passage 79 through the air blower chamber 81A. Said discharge port 114A is equipped with a damper thermostat 115 which senses the temperature of the upper chamber 113 and opens and closes the discharge port 114A, and the damper thermostat 115 is closed by a cover 116. Part of cold air discharged from the air blower for the refrigerating chamber passes through the duct 114 and the damper thermostat 115 and is discharged into the upper chamber 113 through discharge ports 116A formed at the right and left of said cover 116. After that, said cold air passes through the upper and lower insulated boxes 62 and 61 and returns to the cold air passage 79 through a cold air return passage (not shown) which connects the lower front of the upper chamber 113 and the cold air passage 79. The temperature inside the upper chamber 113 can be selected ranging from a chilling temperature of +3° C. or the like to +15° C. or the like which suits to store wine or the like by changing the setting of the damper thermostat 115. Numeral 117 is an insulating door of the upper chamber 113 whose upper end is supported by hinges 118. Numeral 119 is a control box which is fitted horizontally at the upper front of the lower insulating box 61 and protrudes forward between said door 117 and the first and second doors 84 and 85. Various switches are exposed on the front of said control box 119 and a lighting apparatus 120 is installed inside. Said control box 119 is formed to a hollow box with bended metallic plates. It is situated between said door 117 and the first and second doors 84 and 85 and fitted to the front of the outer box 63. The control box 119 protrudes forward from the doors 117, 84 and 85 and said lighting apparatus 120 housed inside is fitted horizontally so that at least part thereof also protrudes forward from the front of said doors 117, 84 and 85. The lighting apparatus 120 is composed of a well-known fluorescent lamp. Formed on the upper and lower surfaces of the control box 119 which is situated over and under the lighting apparatus 120 are plural through holes which are located ahead of the doors 117, 84 and 85 and open horizontally with plural louvers. The louvers formed on the upper surface of the control box 119 point to the upper chamber 113 and those on the lower surface of the control box point to the refrigerating chamber 67. With this arrangement, the light of the lighting apparatus 120 is well emitted to the front of the doors 117, 84 and 85 vertically and also to the upper chamber 113 and the refrigerating chamber 67.

Said lighting apparatus 120 is put on when any of the doors 76, 100, 84, 85 and 117 is opened. Namely, when the door 117 is open, the light of the lighting apparatus 120 is emitted to the inside of the upper chamber 113 from the lower front and when the first door 84 or the second door 85 is opened, the light is emitted to the inside of the refrigerating chamber 67 from the upper front. Furthermore, when the insulating door 100 or 76 is pulled out and the container 101 or the basket 77 is drawn out, the light passing through the front of the first and second doors 84 and 85 is emitted to food inside the container 101 or the basket 77 from the upper part thereof. With the above-mentioned composition, food stored in the storage chambers which are closed tightly with the rotatable doors and stored food pulled out by the drawer type doors can be lighted up by a single lighting apparatus. This increases usability and contributes to the decreases in cost as it is not necessary to install a lighting apparatus in each storage chamber. In addition, since the lighting apparatus is situated outside the refrigerator, when the lighting apparatus is lighted, the light does not heat the inside of the storage chamber and such practical effects are great.

Formed under the lower insulated box 61 is a machine room 122 which is situated between a base 121 and a bottom surface 63A of the outer box 63 and part of said machine room 122 is open forward. Installed in said machine room 122 are the freezers 72 and 80, an electrically driven compressor 123 and a condenser 124 which compose a refrigerant circuit. Numerals 125 and 125 are wheels for transportation fitted to the base. Numeral 126 is a machine room cover which covers the front opening of said machine room 122. Installed on the rear of said machine room cover is a footstep plate 127 which extends to the inner part over the machine room 122 nearly horizontally along the bottom surface 63A. Said footstep plate 127 and the machine room cover 126 may be formed as a unit by synthetic resin for example. Installed at the lower ends on both sides of the machine room cover 126 are rollers 128 and 128 which roll on the floor. Said footstep plate 127 is slidably supported by a pair of rollers 129 installed on the inside surface of the outer box 63 on both sides of the front of the machine room 122. With this arrangement, when the machine room cover 126 is pulled forward, the footstep plate 127 follows. Therefore, when the goods are taken in and out of the upper chamber 113, mounting said footstep plate 127 facilitates work. Since the footstep plate 127 can be pulled out together with the machine room cover 126, the double trouble of removing the machine room cover 126 and pulling or fitting or the like the footstep plate 127 can be saved. Repair of the parts or the like in the machine room 122 can be made by removing the machine room cover 126 and the footstep plate 127. Numeral 130 is a stopper projectingly formed at the rear of the footstep plate 127, and 131 and 131 are projections for deciding housing positions formed at fixed intervals on the front. When the footstep plate 127 is pulled out, the front is supported by the rollers 128 and the rear by the rollers 129 and thus a stable footstep surface is composed.

What is claimed is:

1. A refrigerator comprising:

an insulated box having an opening and a cooling mechanism;

first and second doors of French door type pivotally mounted on said opening and having gaskets at the rear fringe thereof which come in contact with the edge of said opening to close said opening;

guide grooves formed at guide members protruding from the edges of the opening of the insulated box on the non-supporting side of said doors, consisting of a projecting part having a flat front with a surface formed to become nearly the same as that of the opening of the insulated box and a back composed of a semi-circular curve and a jetty formed behind said projecting part at a distance and having a curved surface facing the curved surface of said projecting part and having a curvature of a predetermined configuration;

a partition pivotally supported at the rear on the nonsupporting side of said first door, extending in the direction of the rotating axis of said first door with length nearly reaching the edges of said opening and having at both ends thereof engaging parts rotating along said guide grooves with the closing movement of said first door, and forming the contact surface of said gaskets with the surface of its front nearly joining the edges of said opening when the partition is rotated, and a housing part provided at the rear of said first door and housing and holding said partition with said engaging parts protruded when said first door is open.

2. The refrigerator as defined in claim 1 wherein the guide grooves are formed at guide members which protrude from the edges of the opening of the insulated box.

3. The refrigerator as defined in claim 1 wherein the partition is equipped with a magnetic plate at the back thereof and the housing part is provided with a permanent magnet at the back which confronts the back of the partition.

4. A refrigerator comprising:

an insulated box having an opening and a cooling mechanism;

first and second doors of French door type pivotally mounted on said opening and having gaskets at the rear fringe thereof contacting the edge of said opening to close said opening;

guide grooves formed at the edges of said opening on the non-supporting side of said doors;

a partition pivotally supported at the rear on the non-supporting side of said first door, extending in the direction of the rotating axis of said first door with length nearly reaching the edges of said opening and having at both ends thereof engaging parts rotating along said guide grooves with the closing movement of said first door, and forming the contact surface of said gaskets with the surface of its front nearly joining the edges of said opening when the partition is rotated, and a housing part situated on the side with a projecting wall provided on the rear of the first door to support storage pockets, housing and holding said partition with said engaging parts protruded when said first door is open.

5. A Refrigerator comprising:

an insulated box having an opening and a cooling mechanism;

first and second doors of French door type pivotally mounted on said opening and having gaskets at the rear fringe thereof contacting the edge of said opening to close said opening;

guide grooves formed at the edges of said opening on the non-supporting side of said doors;

a partition pivotally supported at the rear on the non-supporting side of said first door, extending in the direction of the rotating axis of said first door with length nearly reaching the edges of said opening and having at both ends thereof engaging parts rotating along said guide grooves with the closing movement of said first door, and forming the contact surface of said gaskets with the surface of its front nearly joining the edges of said opening when the partition is rotated, and a housing part provided at the rear of said first door and housing and holding said partition with said engaging parts protruded when said first door is open, the housing part having a substantially channel shape in section and equipped with plural ribs on the back thereof to support storage pockets.

* * * * *